United States Patent [19]

Ihama et al.

[11] Patent Number: 4,828,972

[45] Date of Patent: May 9, 1989

[54] METHOD FOR MANUFACTURING SILVER HALIDE EMULSION

[75] Inventors: Mikio Ihama; Sadanobu Shuto; Tadaaki Tani; Naoyasu Deguchi, all of Kanagawa, Japan

[73] Assignee: Fuji Photo Film Co., Ltd., Kanagawa, Japan

[21] Appl. No.: 113,397

[22] Filed: Oct. 26, 1987

Related U.S. Application Data

[63] Continuation of Ser. No. 791,951, Oct. 28, 1985, abandoned.

[30] Foreign Application Priority Data

Oct. 26, 1984 [JP] Japan ..... 59-225384

[51] Int. Cl.[4] ..... G03C 1/02

[52] U.S. Cl. ..... 430/596; 430/569; 430/570

[58] Field of Search ..... 430/569, 570, 596

[56] References Cited

U.S. PATENT DOCUMENTS

| | | | |
|---|---|---|---|
| 3,628,960 | 12/1971 | Philippaerts | 430/571 |
| 4,225,666 | 9/1980 | Locker et al. | 430/569 |
| 4,683,193 | 7/1987 | Ihama et al. | 430/570 |

*Primary Examiner*—Mukund J. Shah

*Attorney, Agent, or Firm*—Sughrue, Mion, Zinn, Macpeak & Seas

[57] ABSTRACT

A method for manufacturing a silver halide emulsion comprising the steps of forming silver halide grains in the presence of a hydrophilic colloid, physical ripening, desalting, and chemical ripening, wherein a photographic spectral sensitizing dye is added to the emulsion after adding at least 85% by weight of a soluble silver salt solution but before the desalting step is described.

11 Claims, No Drawings

METHOD FOR MANUFACTURING SILVER HALIDE EMULSION

This is a continuation of application Ser. No. 791,951, filed Oct. 28, 1985, now abandoned.

FIELD OF THE INVENTION

The present invention relates to a method for manufacturing a spectrally sensitized silver halide emulsion, and more particularly to a manufacturing method for a highly sensitive, spectrally sensitized silver halide emulsion.

BACKGROUND OF THE INVENTION

Generally, a silver halide emulsion is prepared by a step involving the formation of silver halide grains by double decomposition of a soluble silver salt with a soluble halide in an aqueous gelatin solution, followed by a physical ripening step, a desalting step, and a chemical ripening (after-ripening or second ripening) step of the resulting emulsion.

A spectral sensitizing dye is, in general, added to a photographic emulsion which has already been chemically sensitized before it is applied to a substrate. In U.S. Pat. No. 4,425,426, however, methods involving adding a spectral sensitizing dye to a photographic emulsion before the beginning of, or in the course of, chemical sensitization have been disclosed. Further, in U.S. Pat. Nos. 2,735,766, 3,628,960, 4,183,756, and 4,225,666, methods involving adding a spectral sensitizing dye to a photographic emulsion before completion of the formation of silver halide grains have been disclosed.

More particularly, U.S. Pat. Nos. 4,183,756 and 4,225,666 disclosed that a method involving adding a spectral sensitizing dye to a photographic emulsion after formation of stable nuclei, in particular until adding 85% by weight of a silver salt solution, during the formation step of silver halide grains had advantages, such as an increase in photographic sensitivity and strengthened adsorption of the spectral sensitizing dye by silver halide grains. However, such an addition method is not only troublesome to carry out, but also presents problems in that it changes significantly the grain size distribution and the form of the silver halide grains formed, and damages the photographic performance of the emulsion.

SUMMARY OF THE INVENTION

A first object of the invention is to provide an improved spectral sensitizing method for a photographic emulsion by which adsorption of the spectral sensitizing dye can be strengthened and high sensitivity can be obtained.

A second object of the invention is to provide a simple, convenient, and improved, spectral sensitizing method for a photographic emulsion, by which high sensitivity can be obtained without damaging the photographic performance of the emulsion.

According to the present invention, it has now been found that an improved silver halide emulsion having high photographic sensitivity and having a spectral sensitizing dye strongly adsorbed on the silver halide grains can be manufactured by adding the spectral sensitizing dye to the emulsion. That is, it has been found that the above-described objects of the present invention can be achieved by a method for manufacturing a silver halide emulsion comprising the steps of forming silver halide grains in the presence of a hydrophilic colloid, physical ripening, desalting, and chemical ripening (after-ripening or second ripening), wherein a photographic spectral sensitizing dye is added to the emulsion after adding at least 85% by weight of a soluble silver salt solution but before the desalting process.

DETAILED DESCRIPTION OF THE INVENTION

The addition time of a spectral sensitizing dye can be selected in terms of optimum time depending upon the formulation of a silver halide emulsion (e.g., halogen composition, grain size, etc.) and the kind of a spectral sensitizing dye, and it is preferably after completion of the addition of a soluble silver salt solution of at least 90% by weight and more preferably at least 95% by weight. Further, the addition of the spectral sensitizing dye may be effected at the time point when the addition of the silver salt has been completed or in a range of from the completion of addition of the silver salt solution to the desalting (e.g., at the time of physical ripening).

The addition time of the spectral sensitizing dye is selected as described above. This addition time is mainly corresponding to the last stage of the formation step of grains or the physical ripening. Further, it is preferred that after completion of the addition of the spectral sensitizing dye, a soluble silver salt solution is not newly added.

In the present invention, though the spectral sensitizing dye is used to the desalting step, it can be added until the completion of the desalting step. In order that the non-adsorbed or excessive spectral sensitizing dye does not adversely affect the post-steps, it is preferred that the addition of the spectral sensitizing dye is substantially completed until the beginning of the desalting process.

The spectral sensitizing dye can be added to a photographic emulsion in the form of solution thereof in water or in an organic solvent. A substantially water-insoluble spectral sensitizing dye can be used in the form of a dispersion thereof in a water-containing solvent, as disclosed in the specification of Japanese Patent Application (OPI) No. 53867/1984 (the term "OPI" as used herein refers to a "published unexamined Japanese patent application"). The total amount of the spectral sensitizing dye may be added at once, may be divided to add it at several points in time, or may be continuously or intermittently added over a specified time period.

The sensitizing dye for use in the invention is not specially limited. As the sensitizing dye, for example, there may be mentioned methine dyes and styryl dyes such as cyanine dyes, merocyanine dyes, hemicyanine dyes, rhodacyanine dyes, oxonol dyes and hemioxonol dyes. Of these dyes, monomethine dyes and trimethine cyanine dyes having one or two sulfonic groups or sulfoalkyl groups as a substituent group are effective, and oxacarbocyanine, thiacarbocyanine and benzimidacarbocyanine are specially effective.

Examples of spectral sensitizing dyes that can be used, in addition to those mentioned above, are described in West German Pat. No. 929,080, U.S. Pat. Nos. 2,493,748; 2,503,776; 2,519,001; 2,912,329; 3,656,959; 3,672,897; 3,694,217; 4,025,349; 4,046,572; 2,688,545; 2,977,229; 3,397,060; 3,522,052; 3,527,641; 3,617,293; 3,628,964; 3,666,480; 3,672,898; 3,679,428; 3,703,377; 3,814,609; 3,837,862; and 4,026,707; British Pat. Nos. 1,242,588; 1,344,281; and 1,507,803; Japanese Patent Publication Nos. 14,030/1969; 24,844/1977; 4,936/1968; and 12,375/1978; Japanese Patent Application (OPI) Nos. 110,618/1977; 109,925/1977; and 80,827/1975; and the like.

The amount of sensitizing dye added to a silver halide emulsion when it is prepared varies with the type of additives and with the amount of silver halides. However, the sensitizing dye can be employed in the present invention in an amount substantially equal to the amount in which it could be used in a conventional method.

Thus, the preferred amount of spectral sensitizing dye added is from 0.01 to 10 mmol per mol of silver halide and the further preferred amount of the spectral sensitizing dye is from 0.1 to 1 mmol per mol of silver halide.

The spectral sensitizing dyes for use in the present invention are preferably those having a solubility of 0.01 wt % or less in water.

In the silver halide emulsions for use in the invention, any one of silver bromide, silver iodobromide, silver iodochlorobromide, silver chlorobromide, silver chloride and the like may be used as the silver halide. The silver halide grains in the emulsion may be regular crystals such as cubic, octahedral, rhombododecahedral and tetradecahedral crystals or irregular crystals such as spherical and tabular crystals or complexes thereof. Further, an emulsion in which tabular silver halide grains having a diameter of at least 5 times the thickness account for at least 50% of the total projected area may be used. (The details are described in Japanese Patent Application (OPI) No. 127921/1983 and *Research Disclosure,* 225, pp. 20–58, Item 22534, January, 1983.) The grain size of silver halide grains is not particularly limited. These silver halide emulsions can be prepared easily by methods described in the literatures, such as *Chimie et Physique Photographique* by P. Glafkides (Paul Montel Co., 1967), *Photographic Emulsion Chemistry* by G. F. Duffin (The Focal Press, 1966), *Making and Coating Photographic Emulsion* by V. L. Zelikman et al (The Focal Press, 1964), and the like.

Any one of acid method, neutral method, ammonia method, and the like may be used, and as a method for reacting a soluble silver salt with a soluble halogen salt, any one of a single jet mixing method, a simultaneous (double jet) mixing method, and the combination of the two may be used.

A method for forming grains in the presence of excessive silver ions (that is, a so-called reverse mixing method) can also be used. As a form of the simultaneous mixing method, a method for maintaining the pAg in the liquid phase in which silver halides are formed at a constant level, that is, a so-called controlled double jet method, may be used.

In the formation step of silver halide grains or in the physical ripening step of the emulsion, cadmium salts, zinc salts, lead salts, thallium salts, iridium salts or their complex salts, rhodium salts or their complex salts, iron or its complex salts, or like stabilizing agents may be used.

After completion of grain formation in a photographic emulsion (that is, after precipitate formation of silver halide grains or after physical ripening of the emulsion) and further after completion of the addition of spectral sensitizing dye, removal of soluble salts from the emulsion (that is, the so-called desalting process) is usually carried out. For that purpose, the well-known noodle washing method with water may be carried out after the gelatin is allowed to gel, or a flocculation method employing a sodium sulfate solution comprising polyvalent anions, an anionic surface active agent, an anionic polymer (for example, polystyrene sulfonic acid), or a gelatin derivative (for example, aliphatic acylated gelatin, aromatic acylated gelatin, aromatic carbamoyled gelatin, or the like) may be used.

The form of silver halide grains can be determined from the electron micrograph of the grains by a carbon replica method. The grain size and grain size distribution of silver halide grains can be measured with an optical microscope, and electron microscope, a Coulter Counter and a Quantimet image analyzer. Electron micrograph images of silver halide grains are shown and a measuring method for the grain size thereof is described in *The Theory of the Photographic Process,* 4th ed., compiled by T. H. James (MacMillan Publishing Co. 1977), Chapter 3, *Precipitation and Growth of Silver Halide Emulsion Grains* (by C. R. Berry).

The silver halide emulsion is usually sensitized chemically. For the chemical sensitization, a method as described, e.g., in *Grundlagen der Photographischen Prozesse mit Silber-halogeniden*, compiled by H. Frieser (Akademische Verlagsgesellschaft, 1968), pages 675–734, can be used.

A sulfur sensitizing method employing compounds containing sulfur reactable with active gelatin or silver (for example, thiosulfates, thioureas, mercapto compounds, and rhodanines), a reduction sensitizing method employing reducing substances (for example, stannous salts, amines, hydrazine derivatives, formamidinesulfinic acid, and silane compounds), a noble metal sensitizing method employing noble metal compounds (for example, gold complex salts, and complex salts of the VIII group metals in Periodic Table such as Pt, Ir, Pd, and the like), and the like can be used individually or in combination with each other.

Various compounds can be contained in the emulsion for use in the invention with the aim of preventing the fogging of sensitized materials in the manufacturing process, during storage, and during photographic treatment thereof, or with the aim of stabilizing the photographic performance of the sensitized materials.

Examples of compounds known as antifogging agents or as stabilizers that can be added to the emulsion include azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), and the like; mercaptopyrimidines; mercaptotriazines; thioketone compounds such as oxadorinethione; azaindenes, for example, triazaindenes, tetrazaindenes (in particular, tetrahydroxy-substituted (1,3,3*a*, 7)-tetrazaindenes), pentazaindenes, and the like; benzene thiosulfonic acid; benzene sulfinic acid; benzenesulfonamide; and the like.

The photographic emulsion for use in the invention may be spectrally sensitized by adding methine dyes or the like to the emulsion before the desalting step, before the emulsion is applied to an appropriate substrate, or in the chemical ripening step of the emulsion. Dyes for use in the invention include cyanine dyes, merocyanine dyes, complex cyanine dyes, complex merocyanine dyes, holopolar cyanine dyes, hemicyanine dyes, styryl dyes, and hemioxonole dyes. Dyes belonging to cyanine dyes, merocyanine dyes and complex merocyanine dyes are particularly useful. Any ring for usual use in cyanine dyes as a basic heterocyclic ring is applicable to these dyes.

A dye which itself has no spectral sensitizing action or a substance which does not substantially absorb visible light but shows strong color sensitization may be contained in the emulsion together with the sensitizing dye. For example, aminostil compounds substituted by a nitrogen-containing heterocyclic group (for example, the compounds described in U.S. Pat. Nos. 2,933,390 and 3,635,721), the condensation product of an aromatic organic acid and formaldehyde (for example, the compounds mentioned in U.S. Pat. No. 3,743,510), cadmium salts, azaindene compounds, or the like may be contained in the emulsion. The combination of these compounds as described in U.S. Pat. Nos. 3,615,613; 3,615,641; 3,617,295; and 3,635,721 is especially useful.

Various other additives can be used in silver halide emulsions for use in the invention. In other words, surface active agents, hardeners, thickening agents, dyestuffs, ultraviolet light absorbing agents, antistatic agents, brightening agents, desensitizers, developing agents, fading prevention agents, mordants, and the like can be used. In addition, a coupler such as a color coupler can be dispersed in an oil for use.

Such additives are described, e.g., in *Research Disclosure* (RD No. 17643), Vol. 176, pages 22–31 (December, 1978), and in *The Theory of The Photographic Process*, 4th Ed. compiled by T. H. James (MacMillan Publishing Co. 1977).

As a hydrophilic colloid or binder for use in the silver halide emulsion of the invention, gelatin is suitable, but, besides gelatin, derivatives of gelatin such as phthalated gelatin, albumin, agar, gum arabic, a cellulose derivative, polyvinyl acetate, polyacrylamide, polyvinyl alcohol, or the like, can be used.

Examples of the invention will be described hereinafter. However, the invention is not limited to the examples.

EXAMPLE 1

Method 1 (Comparative example)

An aqueous gelatin solution with an addition of $1.6\times10^{-4}$ mol/mol Ag of the following compound (Compound 1) was maintained at 75° C.

(Compound 1)

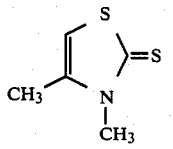

Maintaining the silver potential of the reaction solution while stirring, at a constant value (−90 mV vs standard calomel electrode, SCE), an aqueous 1N silver nitrate solution and an aqueous mixed solution of potassium bromide and potassium iodide were added to the reaction solution at the same speed for 60 min. to form octahedral silver iodobromide grains having a silver iodide content of 2 mol % and then the desalting by a conventional flocculation method was carried out to prepare a photographic emulsion. The silver halide grains had an average grain size of 1.03 microns, and a coefficient of variation of the grain size of 8.9%.

The optimum amount of an aqueous $Na_3Au(S_2O_3)_3$ solution was added to the above-mentioned emulsion, which was then ripened at 50° C. for 60 min. to carry out the gold-sulfur sensitization. Subsequently, a solution of $8.5\times10^{-5}$ mol/mol Ag of a photographic spectral sensitizing dye (Dye 1) having the following structure in methyl cellosolve was added to the ripened emulsion.

(Dye 1)

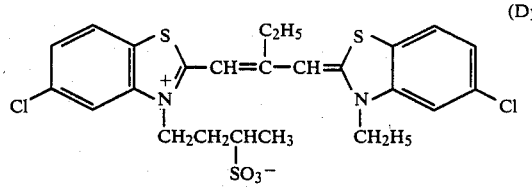

Method 2 (Comparative example)

Octahedral silver iodobromide grains were formed in the same way as in Method 1, and then the desalting step by a flocculation method was carried out to prepare a photographic emulsion. Subsequently, a solution of $8.5\times10^{-5}$ mol/mol Ag of Dye 1 in methyl cellosolve was added to the emulsion, and thereafter, the optimum amount of an aqueous $Na_3Au(S_2O_3)_3$ solution was added to the emulsion, which was then ripened at 50° C. for 60 min. to carry out the gold-sulfur sensitization.

Method 3 (Comparative example)

In the same formation step of silver halide grains as in Method 1, the solution of $8.5\times10^{-5}$ mol/mol Ag of Dye 1 in methyl cellosolve was added to the aqueous gelatin solution at the same rate over a period ranging from 2 min. after the beginning of addition of both the aqueous silver nitrate solution and the aqueous mixed solution of alkali halides to 2 min. before the completion of addition of both the aqueous solutions. After silver iodobromide grains had been formed under such conditions, the desalting step by a flocculation method was carried out to prepare a photographic emulsion. Thereby, clearly distorted octahedral silver iodobromide grains were obtained having an average grain size (diameter) of 1.04 microns and a coefficient of variation of grain size of 13.5%. The optimum amount of an aqueous $Na_2Au(S_2O_3)_3$ solution was added to the emulsion and then the emulsion was ripened at 50° C. for 60 min. to carry out the gold-sulfur sensitization of it.

Method 4 (this invention)

In the same formation step of silver halide grains as in Method 1, the solution of $8.5\times10^{-5}$ mol/mol Ag of dye 1 in methyl cellosolve was added to the aqueous gelatin solution at the same rate over a period ranging from 8 min. to 2 min. before the completion of addition of both the aqueous silver nitrate solution and the aqueous mixed solution of alkali halides. The same octahedral silver iodobromide grains as in Method 1 were formed and they had an average grain size of 1.06 microns and a coefficient of variation of grain size of 9.0%. The optimum amount of an aqueous $Na_3Au(S_2O_3)_3$ solution was added to the resulting emulsion, which was then ripened at 50° C. for 60 min. to carry out the gold-sulfur sensitization.

Emulsions obtained in Methods 1 to 4 were applied to a triacetyl cellulose (TAC) film support and dried. These films were exposed to a tungsten bulb (a color temperature of 2854° K.) for one second through a color filter and a continuous wedge. As the color filter, a gelatin filter BPN 42 (a product of Fuji Photo Film Co., Ltd.) was used to determine the intrinsic sensitivity and a gelatin filter SC 52 (also product of Fuji Photo Film Co., Ltd.) was used to determine the spectrally sensitized sensitivity. The exposed film was developed at 20° C. for 4 min. using a developing liquid prepared by diluting D72 (a product for all-purpose MQ developer made by Eastman Kodak Company) twofold with water. When the photographic sensitivity was represented by the reciprocal of an exposure amount required to give an optical density of the fog plus 0.1 of a developed film, the photographic sensitivity obtained in Method 1 was taken as 100, and then the sensitivity of other methods was represented relatively to Method 1. Further, the coefficient of variation was expressed by "(standard deviation/average value)×100".

The characteristics of emulsions obtained by Methods 1 to 4 are shown in Table 1.

TABLE 1

| Emulsion | Average grain size (micron) | Coefficent of variation (%) | Grain form | Intrinsic sensitivity (relative value) | Spectrally sensitized sensitivity (relative value) |
|---|---|---|---|---|---|
| Method 1 Comparison example | 1.03 | 8.9 | octahedron | 100 | 100 |
| Method 2 Comparison example | 1.03 | 8.9 | octahedron | 98 | 144 |
| Method 3 Comparison example | 1.04 | 13.5 | distorted octahedron | 282 | 479 |
| Method 4 Invention | 1.06 | 9.0 | octahedron | 309 | 661 |

As shown clearly by the experimental results in Table 1, the emulsion of Method 4 of the invention had very high sensitivity values as compared with the emulsions of Methods 1 and 2. Further, in comparison with the emulsion of Method 3, the emulsion of Method 4 had octahedral silver halide grains of regular shape, a narrow grain size distribution and high sensitivity values. It is thus clear that the emulsion prepared in accordance with the invention had high performance as compared with those prepared by the conventional methods.

EXAMPLE 2

Method 5 (Comparative example)

After an aqueous ammonia solution was added to an aqueous gelatin solution maintained at 50° C. while stirring, 720 ml of an aqueous 1N silver nitrate solution and an aqueous mixed solution of potassium bromide and potassium iodide were added to the gelatin solution over a 90 min. period while maintaining the silver potential at a constant value (+40 mV), and after that, the desalting by a flocculation method was carried out to prepare an emulsion comprising tetradecahedral silver iodobromide grains which had a silver iodide content of 3 mol %. The silver halide grains had an average grain size of 0.82 micron and a coefficient of variation of grain size of 8.4%.

The optimum amount of an aqueous solution of $Na_3Au(S_2O_3)_3$ was added to the above-mentioned emulsion and the emulsion was ripened at 60° C. for 60 min. to carry out the gold-sulfur sensitization. Subsequently, to the ripened emulsion, a solution of $8\times10^{-4}$ mol/mol Ag of Dye 1 in methyl cellosolve and a solution of $3\times10^{-5}$ mol/mol Ag of a photographic spectral sensitizing dye (Dye 2) having the structure indicated below in methyl cellosolve were added.

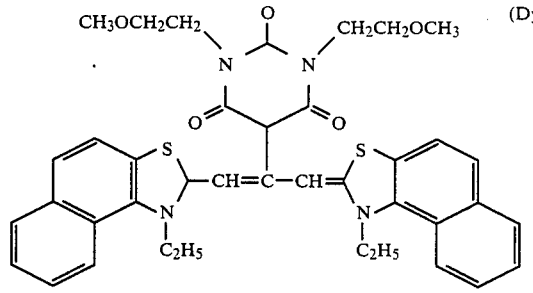

(Dye 2)

Method 6 (Comparative example)

In the same formation step of silver halide grains as in Method 5, the solution of $8\times10^{31\ 4}$ mol/mol Ag of Dye 1 in methyl cellosolve and the solution of $3\times10^{-5}$ mol/mol Ag of Dye 2 in methyl cellosolve were added to the gelatin solution at the same rate over a period ranging from 20 min. to 80 min. after beginning of addition of both the aqueous silver nitrate solution and the aqueous mixed solution of alkali halides. The thus obtained silver halide grains had an average grain size of 0.85 micron and a coefficient of variation of grain size of 7.8%. The optimum amount of an aqueous $Na_3Au(S_2O_3)_3$ solution was added to the emulsion and the emulsion was ripened at 61° C. for 60 min. to carry out the gold-sulfur sensitization.

Method 7 (this invention)

In the same formation step of silver halide grains as in Method 5, the solution of $8\times10^{-4}$ mol/mol Ag of Dye 1 in methyl cellosolve and the solution of $3\times10^{-5}$ mol/mol Ag of Dye 2 in methyl cellosolve were added to the gelatin solution at the same time the addition of both the aqueous silver nitrate solution and the aqueous mixed solution of alkali halides completed. The thus obtained silver halide grains had an average grain size of 0.82 micron and a coefficient of variation of grain size of 6.4%. The optimum amount of an aqueous $Na_3Au(S_2O_3)_3$ solution was added to the emulsion and then the emulsion was ripened at 61° C. for 60 min. to carry out the gold-sulfur sensitization.

The emulsions obtained by Methods 5 to 7 were applied to a TAC film support and dried. The film was exposed to a Xenon flash bulb for $10^{-2}$ sec. through a color filter and a continuous wedge. As the color filter, the above-mentioned BPN 42 was used to determine the intrinsic sensitivity and the above-mentioned SC 52 was used to determine the spectrally sensitized sensitivity. The exposed film was developed at 20° C. for 4 min. using a developing liquid prepared by diluting D72 twofold with water. The photographic sensitivity was represented by the reciprocal of an exposure amount required to give an optical density of a half of the fog plus the maximum density of a developed film, the photographic sensitivity obtained in Method 5 was taken as 100, and then the sensitivity of other methods was represented relatively to Method 5.

The characteristics of the emulsions obtained by Methods 5 to 7 are shown in Table 2.

TABLE 2

| Emulson | Average grain size (micron) | Coef-ficent of variation (%) | Grain form | Intrinisic sensitivity (relative value) | Spectrally sensitized sensitivity (relative value) |
|---|---|---|---|---|---|
| Method 5 Compar-ison example | 0.82 | 8.4 | tetra-deca-hedron | 100 | 100 |
| Method 6 Compar-ison example | 0.85 | 7.8 | tetra-deca-hedron | 186 | 180 |
| Method 7 Inven-tion | 0.82 | 6.4 | tetra-deca-hedron | 289 | 292 |

Experimental results as shown in Table 2 indicated clearly that the emulsion prepared by the Method 7 of the invention had very high sensitivity values as compared with emulsions prepared by Methods 5 and 6.

EXAMPLE 3

Method 8 (Comparative example)

An aqueous gelatin solution with an addition of ammonia (0.15 mol/mol AgBr) was heated and maintained at 50° C., and to the gelatin solution, while stirring, an aqueous 1N silver nitrate solution and an aqueous potassium bromide solution were added at the same time at the same rate for 40 min., maintaining the silver potential of the reaction solution at a constant value (+50 mV vs SCE). Thus, cubic silver bromide grains were formed and then, desalting by a flocculation method was carried out to prepare the emulsion. The silver bromide grains had an average grain size of 0.78 micron and a coefficient of variation of grain size of 9.2%.

The optimum amount of an aqueous $Na_2S_2O_3$ solution was added to the emulsion and the emulsion was ripened at 50° C. for 60 min. to carry out the sulfur sensitization of it. Subsequently, a solution of $4.6\times10^{-6}$ mol/mol AgBr of a photographic spectral sensitizing dye (Dye 3) having the following structure in methanol was added to the ripened emulsion.

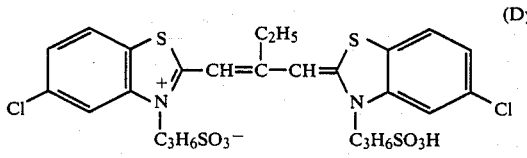

(Dye 3)

Method 9 (Comparative example)

In the same formation step of cubic silver bromide grains as in Method 8, the solution of $4.6\times10^{-4}$ mol/mol AgBr of Dye 3 in methanol was added to the gelatin solution at the same rate over a period ranging from 2 min. after the beginning of addition of both the aqueous 1N silver nitrate solution and the aqueous silver bromide solution to 4 min. before the completion of addition of the latter two solutions. The thus obtained cubic silver bromide grains had an average grain size of 0.80 micron and a coefficient of variation of grain size of 13.0%. The optimum amount of an aqueous $Na_2S_2O_3$ solution was added to the emulsion and the emulsion was aged at 50° C. for 60 min. to carry out sulfur sensitization.

Method 10 (this invention)

In the same formation step of cubic silver bromide grains as in Method 8, the solution of $4.6\times10^{-4}$ mol/mol AgBr of dye 3 in methanol was added to the gelatin solution 2 min. before the finish of addition of both the aqueous 1N silver nitrate solution and the aqueous potassium bromide solution. The thus obtained cubic silver bromide grains had an average grain size of 0.77 micron and a coefficient of variation of grain size of 9.4%. The optimum amount of an aqueous $Na_2S_2O_3$ solution was added to the emulsion and the emulsion was ripened at 50° C. for 60 min. to carry out sulfur sensitization.

Method 11 (this invention)

In the same formation step of cubic silver bromide grains as in Method 8, the solution of $4.6\times10^{-4}$ mol/mol AgBr of Dye 3 in methanol was added to the gelatin solution at a time between the completion of addition of both the aqueous silver nitrate solution and the aqueous potassium bromide solution and the beginning of the desalting step. Subsequently, the optimum amount of an aqueous $Na_2S_2O_3$ solution was added to the resulting emulsion and the emulsion was ripened at 50° C. for 60 min. to carry out the sulfur-sensitization.

The emulsions obtained by Methods 8 to 11 were applied to a TAC film support and dried. The film was exposed to a tungsten bulb (having a color temperature of 2854° K.) for 1 sec. through the above-mentioned color filters BPN 42 and SC 52 and a continuous wedge. The exposed film was developed at 20° C. for 10 min. using a surface developing liquid as set forth below. The photographic sensitivity was represented by the reciprocal of an exposure amount required to give an optical density of the fog plus 0.1 of a developed film. The sensitivity in Method 8 was taken as 100 and the sensitivity in other methods was determined relatively with respect to the sensitivity in Method 8.

Formulation of surface developing liquid:
Water: 500 ml
Metol: 2.5 g
D-Araboascorbic acid: 10 g
Potassium bromide: 1 g
Sodium metaphosphate: 35 g
Water to make: 1,000 ml
pH: 9.8

Sensitivity values of emulsions obtained by Methods 8 to 11 are shown in Table 3.

TABLE 3

| Emulson | Average grain size | Coefficient of variation | Intrinsic sensitivity (relative value) | Spectrally sensitized sensitivity (relative value) |
|---|---|---|---|---|
| Method 8 Comparison example | 0.78 | 9.2 | 100 | 100 |
| Method 9 Comparison example | 0.80 | 13.0 | 280 | 270 |
| Method 10 Invention | 0.77 | 9.4 | 450 | 479 |
| Method 11 Invention | 0.78 | 9.2 | 400 | 400 |

Experimental results as shown in Table 3 indicated clearly that the emulsions of Methods 10 and 11 according to this invention had very high sensitivity values as compared with the emulsions of Methods 8 and 9. Further, the emulsions of Methods 10 and 11 had narrow grain size distribution and high sensitivity values as compared with the emulsion of Method 9. Thus, it has been proved that emulsions prepared in accordance with the invention have high performance as compared with emulsions prepared by conventional methods.

In the light of the above, according to the present invention, by adding the photographic spectral sensitizing dye to the emulsion at the time after the formation of at least almost all of silver halide grains has been completed but before the desalting step, the photographic sensitivity (intrinsic sensitivity and spectrally sensitized sensitivity) can be markedly improved.

Further, according to the method of the present invention, the photographic spectral sensitizing dye can be strongly adsorbed on the silver halide grains. As the result, the desorption of the spectral sensitizing dye after preparation of the emulsion can be reduced.

Still further, according to the present invention, the grain size distribution can be made narrower, i.e., it becomes possible to more monodisperse it (e.g., the coefficient of variation can be made 10% or less), as compared with the method wherein the spectral sensitizing dye is added at the time of formation of silver halide grains. Moreover, the influence of the spectral sensitizing dye against the form of grain or average grain size can be minimized.

While the invention has been described in detail and with reference to specific embodiments thereof, it will be apparent to one skilled in the art that various changes and modifications can be made therein without departing from the spirit and scope thereof.

What is claimed is:

1. A method for manufacturing a sulfur sensitized, surface latent image-type silver halide emulsion comprising the steps of forming silver halide grains in the presence of a hydrophilic colloid, physical ripening, desalting, and chemical ripening, wherein a photographic spectral sensitizing dye selected from the group consisting of a cyanine dye, merocyanine dye and a hemicyanine dye is added to the emulsion only after adding at least 95% by weight of a soluble silver salt solution but before the desalting step.

2. A method for manufacturing a silver halide emulsion as in claim 1, wherein the spectral sensitizing dye is added in an amount of from 0.01 to 10 mmol per mol of silver halide.

3. A method for manufacturing a silver halide emulsion as in claim 1, wherein the spectral sensitizing dye is added in an amount of from 0.1 to 1 mmol per mol of silver halide.

4. A method for manufacturing a silver halide emulsion as in claim 1, wherein said spectrally sensitizing dye has a solubility of 0.01 wt % or less in water.

5. A method for manufacturing a silver halide emulsion as in claim 1, wherein the spectral sensitizing dye is added after completion of the addition of the soluble silver salt solution but before the desalting step.

6. A method for manufacturing a silver halide emulsion as in claim 1, wherein the silver halide grain is regular in the crystal form.

7. A method for manufacturing a silver halide emulsion as in claim 6, wherein the silver halide grain is cubic, octahedral, or tetradecahedral.

8. A method for manufacturing a silver halide emulsion as in claim 1, wherein the silver halide grain is irregular in the crystal form.

9. A method for manufacturing a silver halide emulsion as in claim 8, wherein the silver halide grain is spherical or tabular.

10. A method for manufacturing a silver halide emulsion as in claim 1, wherein the spectral sensitizing dye is a monomethine dye or a trimethine cyanine dye having one or two sulfonic grops of sulfoalkyl groups as a substituent group.

11. A method for manufacturing a silver halide emulsion as in claim 10, wherein the spectral sensitizing dye is oxacarbocyanine, thiacarbocyanine, or benzimidacarbocyanine.

* * * * *